US012416122B2

(12) United States Patent
Wu

(10) Patent No.: US 12,416,122 B2
(45) Date of Patent: Sep. 16, 2025

(54) MATERIAL CONVEYING CONTROL METHOD, SYSTEM AND APPARATUS FOR MILLING PLANER, AND MILLING PLANER

(71) Applicant: Hunan Sany Zhongyi Machinery Co., Ltd., Yiyang (CN)

(72) Inventor: Xucheng Wu, Yiyang (CN)

(73) Assignee: Hunan Sany Zhongyi Machinery Co., Ltd., Yiyang (CN)

( * ) Notice: Subject to any disclaimer, the term of this patent is extended or adjusted under 35 U.S.C. 154(b) by 612 days.

(21) Appl. No.: 17/853,529

(22) Filed: Jun. 29, 2022

(65) Prior Publication Data

US 2022/0333318 A1 Oct. 20, 2022

Related U.S. Application Data

(63) Continuation of application No. PCT/CN2021/104285, filed on Jul. 2, 2021.

(30) Foreign Application Priority Data

Jul. 3, 2020 (CN) ..... 202010630902.9

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

2012/0104828 A1 5/2012 Grathwol
2016/0060828 A1* 3/2016 Killion ..... E01C 23/127 299/1.5
2016/0348324 A1* 12/2016 Engelmann ..... E01C 23/127

FOREIGN PATENT DOCUMENTS

CN 1584214 A 2/2005
CN 200978379 Y 11/2007
CN 102322015 A 1/2012
CN 202194056 U 4/2012
(Continued)

OTHER PUBLICATIONS

First Examination Report issued in counterpart Indian Patent Application No. 202227037785, dated Feb. 7, 2023.
(Continued)

*Primary Examiner* — Carib A Oquendo
(74) *Attorney, Agent, or Firm* — Westbridge IP LLC

(57) ABSTRACT

Disclosed are a material conveying control method, a system and an apparatus for a milling planer, and a milling planer. The material conveying control method for the milling planer includes: acquiring a height adjustment displacement of a material receiver of the milling planer in a floating state; and controlling, according to the height adjustment displacement, a lifting height of the material receiver and a travelling speed of the milling planer, so as to control a material conveying amount of the milling planer. By controlling the lifting height of the material receiver and the travelling speed of the milling planer at the same time, a variation of a milling volume is reduced, thereby reducing an influence of spilled waste on the material conveying amount of the milling planer.

17 Claims, 8 Drawing Sheets

(56) References Cited

FOREIGN PATENT DOCUMENTS

| | | | |
|---|---|---|---|
| CN | 203160105 | U | 8/2013 |
| CN | 103741575 | A | 4/2014 |
| CN | 104389259 | A | 3/2015 |
| CN | 104727210 | A | 6/2015 |
| CN | 104846729 | A | 8/2015 |
| CN | 108004894 | A | 5/2018 |
| CN | 110629642 | A | 12/2019 |
| CN | 110965443 | A | 4/2020 |
| CN | 111676785 | A | 9/2020 |
| DE | 3812809 | A1 | 11/1989 |
| WO | 2015034497 | A1 | 3/2015 |

OTHER PUBLICATIONS

International Search Report issued in corresponding PCT Application No. PCT/CN2021/104285, dated Sep. 29, 2021.
Written Opinion issued in corresponding PCT Application No. PCT/CN2021/104285, dated Sep. 28, 2021.

* cited by examiner

MATERIAL CONVEYING CONTROL METHOD, SYSTEM AND APPARATUS FOR MILLING PLANER, AND MILLING PLANER

CROSS-REFERENCE TO RELATED APPLICATIONS

This application is a continuation of International Application No. PCT/CN2021/104285, filed on Jul. 2, 2021, which claims priority to Chinese Patent Application No. 202010630902.9, filed on Jul. 3, 2020. The entire content of the both applications is incorporated herein by reference in their entireties.

TECHNICAL FIELD

The present application relates to the technical field of milling planer control, and in particular, to a material conveying control method, a system and an apparatus for a milling planer, and a milling planer.

BACKGROUND

During a milling operation of a milling planer, waste generated by a milling drum is scattered on an unmilled road surface, so that a material receiver may be hindered and a milling volume of the milling planer may be changed, thereby increasing a burden on a conveying component and affecting a service life of the conveying component.

SUMMARY

To this end, according to the embodiments of the present application, an object is to provide a material conveying control method for a milling planer.

According to the embodiments of the present application, another object is to provide a material conveying control system for a milling planer.

According to the embodiments of the present application, still another object is to provide a milling planer.

According to the embodiments of the present application, yet still another object is to provide a material conveying control apparatus for a milling planer.

In order to achieve the above mentioned objects, according to an embodiment of a first aspect of the present application, a material conveying control method for a milling planer is provided. The method includes: Step S110: acquiring a height adjustment displacement of a material receiver of the milling planer in a floating state; and Step S200: controlling, according to the height adjustment displacement, a lifting height of the material receiver and a travelling speed of the milling planer, so as to control a material conveying amount of the milling planer.

According to the embodiment of the first aspect of the present application, by acquiring the height adjustment displacement of the material receiver of the milling planer in the floating state, whether the material receiver encounters an obstacle may be determined. During a working process of the milling planer, some waste may be scattered on an unmilled road surface to form the obstacle, thereby hindering the material receiver. When the waste enters a milling operation area, a milling volume of the milling planer may be changed, so that outward conveying of the waste may be affected. The material receiver is controlled to lift according to the height adjustment displacement, and the travelling speed of the milling planer is controlled at the same time, so that the travelling speed of the milling planer matches the height of the material receiver, so as to control the milling volume of the milling planer, and then to adjust the material conveying amount of the milling planer. The floating state refers to a state in which a height adjustment mechanism of the material receiver itself has no driving force and only lifts or lowers under action of external force.

According to the material conveying control method for the milling planer in the embodiments, the lifting height of the material receiver and the travelling speed of the milling planer are controlled at the same time, so that a variation of the milling volume is reduced. Therefore, a process that the milling planer conveys the waste to a waste conveying vehicle may remain relatively stable, and at the same time, an amount of waste generated by the milling planer during the milling operation per unit time is relatively stable. Therefore, the milling volume per unit time of the milling planer fails to exceed a load of conveying components (such as a conveying belt) to a certain extent, so as to delay wear of the conveying components and improve a service life of the conveying component.

The material receiver and a material conveying device of the milling planer are equipped with conveying components, and the conveying components may be conveying belts or other components that may convey waste. After the waste generated by the milling drum enters the material receiver, the waste may be conveyed to a bin of the waste conveying vehicle by using the conveying components of the material receiver and the material conveying device in turn. Therefore, an increase in an amount of waste generated by the milling operation of the milling drum may lead to an increase in the load of the conveying components, affecting the service life of the conveying components.

In addition, the material conveying control method for the milling planer in the above mentioned technical solutions according to the embodiments of the present application may also have the following additional technical features.

In the above technical solution, the Step S200: controlling, according to the height adjustment displacement, a lifting height of the material receiver and a travelling speed of the milling planer, so as to control a material conveying amount of the milling planer specifically includes: Step S210: judging whether the height adjustment displacement is greater than a first displacement threshold, and generating a first judgment result; if the first judgment result is yes, executing Step S220: controlling the material receiver to lift by a first height ratio and keep stable; Step S230: controlling the travelling speed of the milling planer to reduce by a first speed ratio according to the first height ratio; and if the first judgment result is no, executing the Step S110.

In the technical solution, in the specific step of the Step S200, a volume of the obstacle is determined by judging whether the height adjustment displacement of the material receiver is greater than the first displacement threshold. If the height adjustment displacement of the material receiver is greater than the first displacement threshold, it indicates that the volume of the obstacle is relatively large, a blocking effect on the material receiver is relatively great, and an effect on the milling volume of the milling planer is relatively great. At the same time, by controlling the material receiver to lift the first height ratio and keep stable, the material receiver may avoid the obstacle and reduce resistance. Further, the travelling speed of the milling planer is controlled to correspondingly reduce the first speed ratio according to the first height ratio, so that a change of the travelling speed of the milling planer matches the lifting height of the material receiver. When the waste is scattered on the unmilled road surface, the variation of the material conveying amount of the milling planer may be reduced, so as to ensure that the conveying amount of the conveying mechanism is relatively stable. Therefore, the service life of the conveying components (such as the conveying belts) of the milling planer may be improved. The first height ratio refers to a ratio of a lifting height of the material receiver to an allowable maximum lifting height.

In the above technical solutions, the material conveying control method for the milling planer further includes: Step S240: controlling the material receiver to return to the floating state after a first time interval, so as to lower the material receiver by a second height ratio; and Step S250: controlling, according to the second height ratio, the travelling speed of the milling planer to increase by a second speed ratio.

In the technical solutions, after the material receiver lifts by the first height ratio and remains stable, if the material receiver has been determined to pass the obstacle after the first time interval, the material receiver is controlled to return to the floating state, so that the material receiver naturally lowers by the second height ratio under action of gravity and the material receiver returns to a state of contacting the road surface. Correspondingly, the travelling speed of the milling planer is controlled to increase by the second speed ratio, so that the travelling speed of the milling planer matches the height of the material receiver, thereby reducing the variation of the milling volume of the milling drum. The first time interval may be set according to the travelling speed of the milling planer.

In the above technical solutions, the first height ratio is proportional to the first speed ratio, and the second height ratio is proportional to the second speed ratio.

In the technical solutions, by defining that the first height ratio is proportional to the first speed ratio, and the second height ratio is proportional to the second speed ratio, the variation of the travelling speed of the milling planer corresponds to the variation of the lifting height of the material receiver, so as to reduce the change in the milling volume of the milling drum. Further, when a proportional coefficient is properly selected, the milling volume of the milling drum may be kept unchanged.

In the above technical solution, before the Step S110: acquiring a height adjustment displacement of a material receiver of the milling planer in a floating state, the method further includes: Step S101: determining a maximum travelling speed according to an initial milling depth, an engine power and historical data of the travelling speed of the milling planer; Step S102: determining a maximum material conveying amount of the milling planer according to the maximum travelling speed; Step S103: determining a material conveying speed of a conveying mechanism of a material receiver according to the maximum material conveying amount; and Step S104: controlling the conveying mechanism to travel at the material conveying speed.

In the technical solution, the Steps S101 to S104 are further included before the Step S110. According to the initial milling depth of the milling drum, the engine power and the historical data of the travelling speed of the milling planer, the maximum travelling speed of the milling planer is determined, and then the maximum material conveying amount of the milling planer is determined. Further, according to the maximum material conveying amount, the material conveying speed of the conveying mechanism of the material receiver is determined, and the conveying mechanism is controlled to travel at the material conveying speed. Therefore, the change of the material conveying amount caused by the change of the material conveying speed may be reduced during the milling operation, and then the blanking position of the material conveying device may be kept relatively stable when the waste is conveyed to the waste conveying vehicle. Furthermore, it is convenient for the bin to load the waste evenly, and is beneficial to improve the utilization rate of the bin of the material conveying vehicle and the efficiency of conveying the waste.

An embodiment according to a second aspect of the present application provides a material conveying control system for a milling planer. The material conveying control system for a milling planer is used for the milling planer, including: a detection device disposed on a material receiver of the milling planer, and used for detecting a height adjustment displacement of the material receiver; and a controller electrically connected with the material receiver, the detection device and a travelling mechanism of the milling planer, used for controlling, according to the height adjustment displacement of the material receiver in a floating state, a lifting height of the material receiver and a travelling speed of the milling planer, so as to control a material conveying amount of the milling planer.

In the technical solution, the material conveying control system for the milling planer, including the detection device and the controller, is used for the milling planer. The detection device is disposed on the material receiver of the milling planer to detect the height adjustment displacement of the material receiver. The controller is electrically connected with the detection device, the material receiver and the travelling mechanism of the milling planer, so as to determine an volume of the obstacle according to the height adjustment displacement of the material receiver in the floating state. The lifting height of the material receiver and the travelling speed of the milling planer are controlled, so as to avoid the obstacle by controlling the material receiver to lift when the material receiver encounters the obstacle during the milling operation. At the same time, by controlling the travelling mechanism of the milling planer, the travelling speed is correspondingly adjusted, so that an influence of the obstacle on the milling volume of the milling drum is reduced, and then the variation of the material conveying amount of the milling planer is reduced. The amount of waste generated by the milling planer per unit time is relatively stable, and the process that milling planer conveys the waste to the waste conveying vehicle is kept relatively stable. Therefore, wear of the conveying components (such as the conveying belts) is delayed, so as to improve the service life.

In the above mentioned technical solution, the detection device is a displacement sensor.

In the technical solution, by setting a displacement sensor as the detection device, it is convenient to detect the height adjustment displacement of the material receiver. At the same time, the displacement sensor has advantages of high precision, small error, relatively low cost and small volume, which is convenient to install and use, and is easy to implement.

In the above mentioned technical solution, the material conveying control system for the milling planer further includes: a milling depth sensor disposed on the milling planer, and used for detecting a milling depth of a milling drum of the milling planer; and a speed sensor disposed on the travelling mechanism of the milling planer, and used for detecting the travelling speed of the travelling mechanism. The controller is electrically connected with the milling depth sensor and the speed sensor, to control the material conveying speed of the material receiver according to the milling depth of the milling drum, the travelling speed of the travelling mechanism and the engine power of the milling planer.

In the technical solution, the milling depth sensor and the speed sensor are disposed to detect the milling depth of the milling drum and the travelling speed of the travelling mechanism, respectively. The controller is electrically connected with the milling depth sensor and the speed sensor to determine the material conveying speed of the conveying mechanism of the material receiver according to the milling depth of the milling drum and the travelling speed of the travelling mechanism and the engine power of the milling planer. Therefore, the change of the material conveying amount caused by the change of the material conveying speed is reduced, the blanking position of the material conveying device may be kept relatively stable when the waste is conveyed to the waste conveying vehicle, and then the utilization rate of the bin of the conveying vehicle and the efficiency of conveying the waste are improved. The speed sensor may be an angular speed sensor or a linear speed sensor. The milling depth sensor may be a height sensor, a displacement sensor or other sensors that may detect the milling depth of the milling drum.

According to an embodiment of a third aspect of the present application, a milling planer is provided. The milling planer includes: a milling planer body, the milling planer body being disposed with a travelling mechanism; a milling drum disposed at a bottom of the milling planer body and used for milling a road surface; the material receiver disposed at the bottom of the milling planer body and at a discharge position of the milling drum, and used for collecting waste generated during a milling operation of the milling drum; a material conveying device disposed on a front side of the material receiver along a length direction of the milling planer body; and the material conveying control system for the milling planer in any one of the embodiments of the second aspect mentioned above. The material conveying control system for the milling planer is disposed on the material receiver, and the controller of the material conveying control system for the milling planer is electrically connected with the material receiver, the detection device and the travelling mechanism, to control the lifting height of the material receiver and the travelling speed of the travelling mechanism according to the height adjustment displacement amount of the material receiver in the floating state, and then to control the material conveying amount of the milling planer. The controller is electrically connected with the conveying mechanism and the height adjustment mechanism to control working states of the conveying mechanism and the height adjustment mechanism. An initial state of the material receiver is the floating state.

In the technical solution, the milling planer includes the milling planer body, the milling drum, the material receiver, a material conveying device, and the material conveying control system for the milling planer according to any one of the embodiments of the second aspect. The milling planer body is a main structure of the milling planer, and the travelling mechanism is disposed on the milling planer body to drive the milling planer body to travel. The milling drum is disposed at the bottom of the milling planer body to perform the milling operation on the road surface and realize the road surface renovation. The material receiver is disposed at the bottom of the milling planer body and is located at the discharge position of the milling drum, to collect the waste generated by the milling drum during the milling operation. Through the material conveying device disposed on the front side of the material receiver along the length of the milling planer body, the waste collected by the material receiver may be conveyed to the outside, so that the waste may be conveyed, by the waste conveying vehicle or other conveying means, to a designated location to complete conveying of the waste.

The detection device of the material conveying control system for the milling planer is disposed on the material receiver. The controller of the material conveying control system for the milling planer is electrically connected with the material receiver, the detection device and the travelling mechanism, so as to determine a volume of the obstacle, according to the height adjustment displacement of the material receiver in the floating state. The lifting height of the material receiver and the travelling speed of the milling planer are controlled, so as to avoid the obstacle by controlling the material receiver to lift when the material receiver encounters the obstacle during the milling operation. By controlling the material receiver to lift to avoid the obstacle, and at the same time controlling the travelling mechanism of the milling planer to correspondingly adjust the travelling speed, an influence of the obstacle on the milling volume of the milling drum is reduced, and then the variation of the material conveying amount of the milling planer is reduced. Therefore, it is beneficial to improve the service life of the conveying components (such as the conveying belt) and the conveying efficiency of the milling planer. The initial state of the material receiver is the floating state, that is, a state that the material receiver itself has no driving force and only lifts or lowers under the action of external force.

In addition, the milling planer in the solution also has the beneficial effects of the material conveying control system for the milling planer according to any one of the embodiments of the second aspect, which will not be repeated here.

In the above mentioned technical solution, the material receiver includes: a material receiving mechanism, disposed on a front side of the milling drum along the length direction of the milling planer body, a material receiving end of the material receiving mechanism being disposed at the discharging position of the milling drum to collect the waste generated during an operation of the milling drum, and a material discharging end of the material receiving mechanism being disposed corresponding to the material conveying device; a conveying mechanism, disposed on the material receiving mechanism and extended along a length direction of the material receiving mechanism, the conveying mechanism being used for conveying the waste in the material receiving mechanism to the material conveying device; and a height adjustment mechanism being disposed at the bottom of the milling planer body, an end of the height adjustment mechanism being connected with the milling planer body, another end of the height adjustment mechanism being connected with the material receiving mechanism, so as to drive the material receiving mechanism to perform a height adjustment movement. An initial state of the height adjustment mechanism is the floating state.

In the technical solution, the material receiver includes the material receiving mechanism, the conveying mechanism and the height adjustment mechanism. The material receiving mechanism is disposed on the front side of the milling drum along the length direction of the milling planer body, and the material receiving end of the material receiving mechanism is disposed at the discharge position of the milling drum, so as to facilitate collection of the waste generated by the milling drum during the milling operation. A conveying mechanism is disposed on the material receiving mechanism, and used for conveying the waste in the material receiving mechanism. The conveying mechanism extends along the length direction of the material receiving mechanism, so as to facilitate the conveying of the waste to the material conveying device. An end of the height adjustment mechanism is connected with the milling planer body, and another end is connected with the material receiving mechanism, so as to drive the material receiving mechanism to perform the height adjustment movement through the height adjustment mechanism. The controller of the material conveying control system for a milling planer is electrically connected with the conveying mechanism and the height adjustment mechanism to control the working states of the conveying mechanism and the height adjustment mechanism, so that when the material receiving mechanism encounters an obstacle, the material receiving mechanism may be driven to lift to avoid the obstacle and reduce resistance by controlling the height adjustment mechanism. At the same time, the travelling speed of the travelling mechanism of the milling planer is reduced, so as to reduce the variation of the milling volume of the milling drum. The initial state of the height adjustment mechanism is the floating state, that is, a state that the height adjustment mechanism itself has no driving force, and only lifts or lowers under the action of the external force. The conveying mechanism may be a conveying belt mechanism or other mechanism that may convey the waste. The conveying components (such as the conveying belt) are disposed on the conveying mechanism to convey waste.

Further, the height adjustment mechanism is specifically a telescopic oil cylinder or a telescopic cylinder. The material receiving mechanism is driven to perform the height adjustment movement through the telescopic movement of the telescopic oil cylinder or the telescopic cylinder. The telescopic oil cylinder or the telescopic cylinder may provide sufficient driving force, and may achieve a floating state, which is easy to control and easy to implement.

An embodiment according to a fourth aspect of the present application provides a material conveying control apparatus for a milling planer. The apparatus includes a processor; and a memory for storing executable instructions of the processor. The processor executes the following instructions: acquiring a height adjustment displacement of a material receiver of the milling planer in a floating state; and controlling, according to the height adjustment displacement, a lifting height of the material receiver and a travelling speed of the milling planer, so as to control a material conveying amount of the milling planer.

In the above mentioned technical solutions, the processor further executes the following instructions: judging whether the height adjustment displacement is greater than a first displacement threshold and generating a first judgment result; if the first judgment result is yes, controlling the material receiver to lift by a first height ratio and keep stable; controlling a travelling speed of the milling planer to reduce by a first speed ratio according to the first height ratio; and if the first judgment result is no, acquiring the height adjustment displacement of the material receiver of the milling planer in the floating state.

In the above mentioned technical solutions, the processor further executes the following instructions: controlling the material receiver to return to the floating state after a first time interval, so as to lower the material receiver by a second height ratio; controlling, according to the second height ratio, the travel speed of the milling planer to increase by a second speed ratio.

In the above mentioned technical solutions, the first height ratio is proportional to the first speed ratio, and the second height ratio is proportional to the second speed ratio.

In the above mentioned technical solutions, before the processor executes the instruction of acquiring a height adjustment displacement of a material receiver of the milling planer in a floating state, the processor also execute the following instructions: determining a maximum travelling speed according to an initial milling depth, an engine power and historical data of the travelling speed of the milling planer; determining a maximum material conveying amount of the milling planer according to the maximum travelling speed; determining a material conveying speed of the conveying mechanism of a material receiver according to the maximum material conveying amount; and controlling the conveying mechanism to travel at the material conveying speed.

The instructions executed by the processor in the material conveying control apparatus for the milling planer in the solutions are corresponding to the steps in the material conveying control method for the milling planer in any one of the embodiments of the first aspect of the present application. The material conveying control apparatus for the milling planer in the solution has the beneficial effects of the above-mentioned material conveying control method for the milling planer, which will not be repeated here.

Additional aspects and advantages of the embodiments of the present application will become apparent in the description section below or learned by practice of the present application.

BRIEF DESCRIPTION OF DRAWINGS

The above and/or additional aspects and advantages of embodiments of the present application will become apparent and readily understood from the following description of the embodiments in conjunction with accompanying drawings.

DETAILED DESCRIPTION OF THE EMBODIMENTS

During a milling operation of a milling planer, waste generated by a milling drum falls into the material receiver and is conveyed to a waste conveying vehicle through a material conveying device. In the above process, part of the waste may be scattered on an unmilled road surface, and the scattered waste may cause a certain obstruction effect on the material receiver. At the same time, a milling volume of the milling planer may be changed during the milling operation, resulting in a lot of waste on a conveying belt and a large conveying pressure. Therefore, a service life of conveying components (such as the conveying belt) on a conveying mechanism may be shorten in the long run.

Specifically, the present application provides a material conveying control method for a milling planer. By acquiring a height adjustment displacement of a material receiver of the milling planer in a floating state, and controlling, according to the height adjustment displacement, a lifting height of the material receiver and a travelling speed of the milling planer, so as to control a material conveying volume of the milling planer, the lifting height of the material receiver and the travelling speed of the milling planer are controlled at the same time, to reduce a variation of the milling volume. Therefore, a process that the milling planer conveys waste to a waste conveying vehicle remains relatively stable. At the same time, an amount of the waste generated by the milling planer per unit time is relatively stable, so as to avoid the milling volume per unit time of the milling planer exceeding the load of the conveying components (such as the conveying belt) to a certain extent, thereby delaying the wear of the conveying component and improving the service life of the conveying components.

The embodiments according to the present application will be described in further detail below with reference to the accompanying drawings and specific embodiments. The embodiments of the present application and features in the embodiments may be combined with each other without conflict.

Many specific details are set forth in the following description to facilitate a full understanding of the embodiments according to the present application. However, the embodiments according to the present application may also be implemented in other ways different from those described herein. Therefore, the protected scope of the present application is not to be limited by the specific embodiments disclosed below.

A material conveying control method for a milling planer, a material conveying control system for a milling planer, a milling planer, and a material conveying control apparatus for a milling planer according to some embodiments of the present application will be described below with reference to FIGS. 1 to 12.

Figure 1:
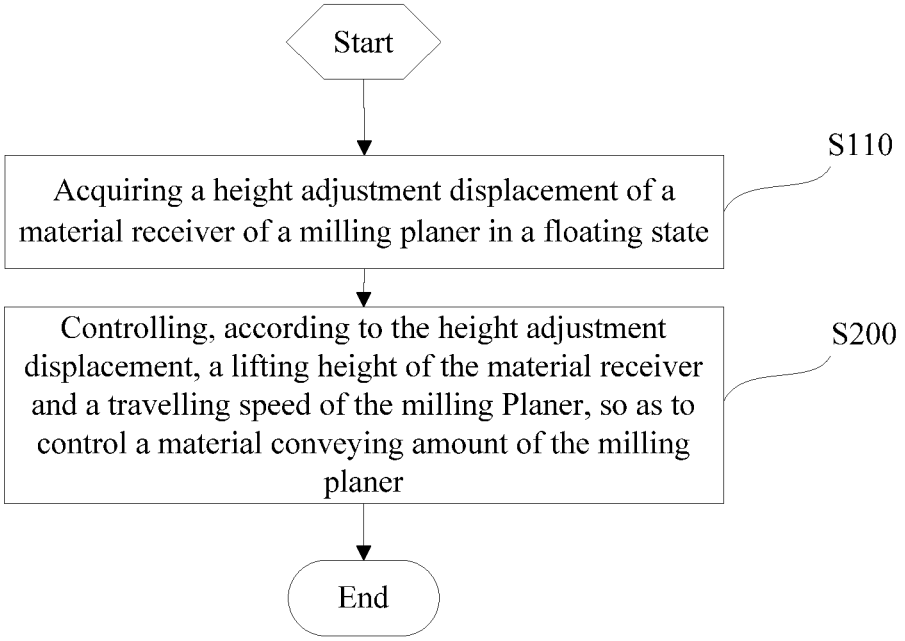
FIG. 1 shows a flowchart of a material conveying control method for a milling planer according to an embodiment of the present application.

This embodiment provides a material conveying control method for a milling planer, as shown in FIG. 1, including the following method steps.

Step S110: acquiring a height adjustment displacement of a material receiver of a milling planer in a floating state.

Step S200: controlling, according to the height adjustment displacement, a lifting height of the material receiver and a travelling speed of the milling planer, so as to control a material conveying amount of the milling planer.

In this embodiment, the height adjustment displacement of the material receiver of the milling planer in the floating state is acquired to determine whether the material receiver encounters an obstacle (including scattered waste). The material receiver is controlled to lift according to the height adjustment displacement to avoid the obstacle. The travelling speed of the milling planer is controlled at the same time, so that the travelling speed of the milling planer matches the height of the material receiver, so as to control a milling volume of the milling planer and then adjust the material conveying amount of the milling planer. The floating state refers to a state in which a height adjustment mechanism of the material receiver itself has no driving force and only lifts or lowers under action of external force. In the material conveying control method for the milling planer in the embodiment, a variation of the milling volume caused by the obstacle is reduced by controlling the lifting height of the material receiver and the travelling speed of the milling planer at the same time, so that an impact on the material conveying amount of the milling planer is reduced when there is scattered waste on a surface of an unmilled road surface. Furthermore, a process that the milling planer conveys the waste to a waste conveying vehicle is kept relatively stable, which is beneficial to improve a service life of conveying components (such as a conveying belt) of the milling planer and material conveying efficiency of the milling planer.

Figure 2:
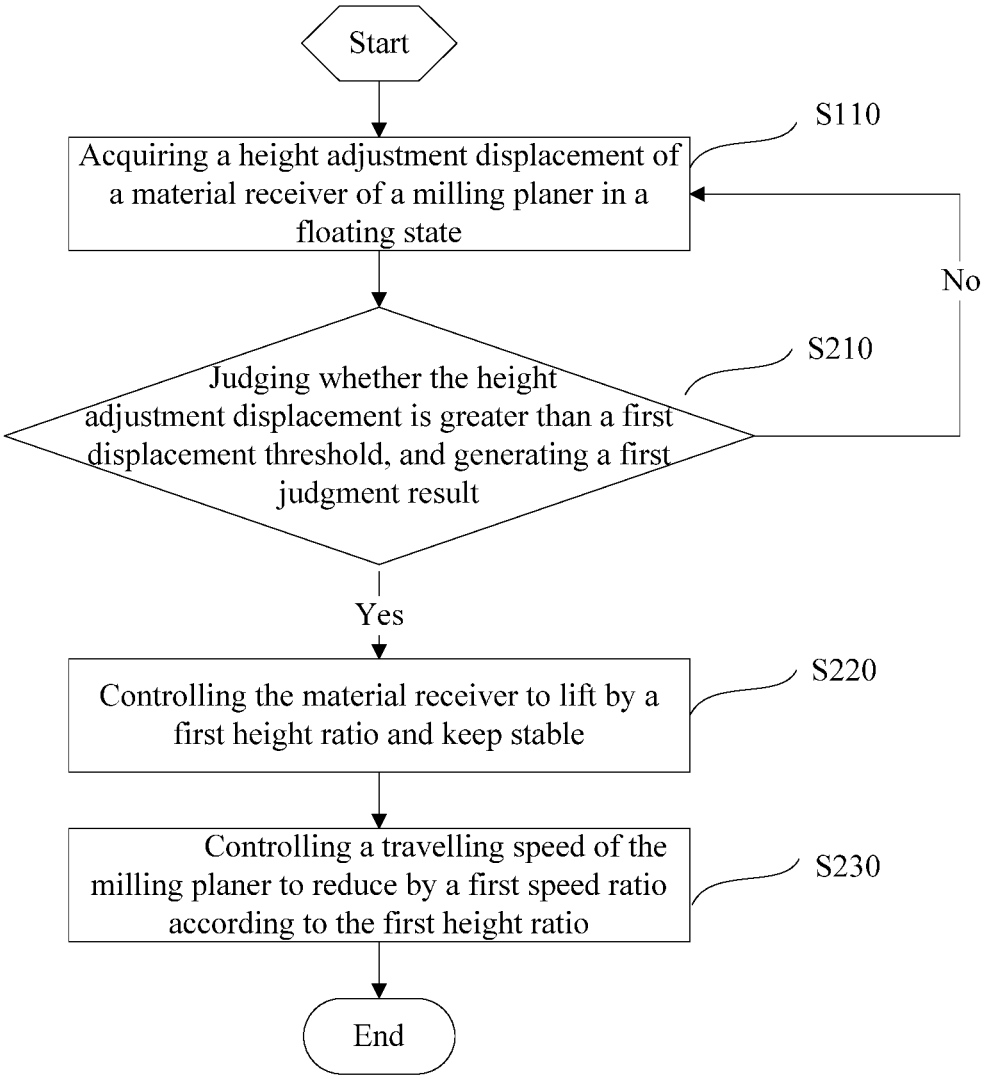
FIG. 2 shows a flowchart of a material conveying control method for a milling planer according to an embodiment of the present application.

This embodiment provides a material conveying control method for a milling planer, as shown in FIG. 2, including the following method steps.

Step S110: acquiring a height adjustment displacement of a material receiver of a milling planer in a floating state.

Step S210: judging whether the height adjustment displacement is greater than a first displacement threshold, and generating a first judgment result. If the first judgment result is yes, executing Step S230, and if the first judgment result is no, executing Step S110.

Step S220: controlling the material receiver to lift by a first height ratio and keep stable.

Step S230: controlling a travelling speed of the milling planer to reduce by a first speed ratio according to the first height ratio.

In the material conveying control method for the milling planer in the embodiment, the Step S200 is further improved on the basis of the embodiments mentioned above. Through the Step S210, it is determined whether the height adjustment displacement of the material receiver is greater than the first displacement threshold, so as to determine a volume of an obstacle, and then determine magnitude of an obstruction effect on the material receiver caused by the obstacle. If the height adjustment displacement of the material receiver is greater than the first displacement threshold, through the Step S220, the material receiver is controlled to lift by the first height ratio and keep stable, so that the material receiver avoids the obstacle, and resistance is reduced, otherwise, the Step S110 is executed. When the material receiver lifts by the first height ratio and is kept in a stable state, through the Step S230, the travelling speed of the milling planer is controlled according to the first height ratio to correspondingly reduce the first speed ratio, so that a change of the travelling speed of the milling planer matches with the lifting height of the material receiver, so as to reduce a variation of a material conveying amount of the milling planer. Therefore, a conveying amount of a conveying mechanism is relatively stable, which is beneficial to improve a service life of conveying components (such as a conveying belt) and material conveying efficiency of the milling planer. The first height ratio refers to a ratio of the lifting height of the material receiver to an allowable maximum lifting height.

Figure 3:
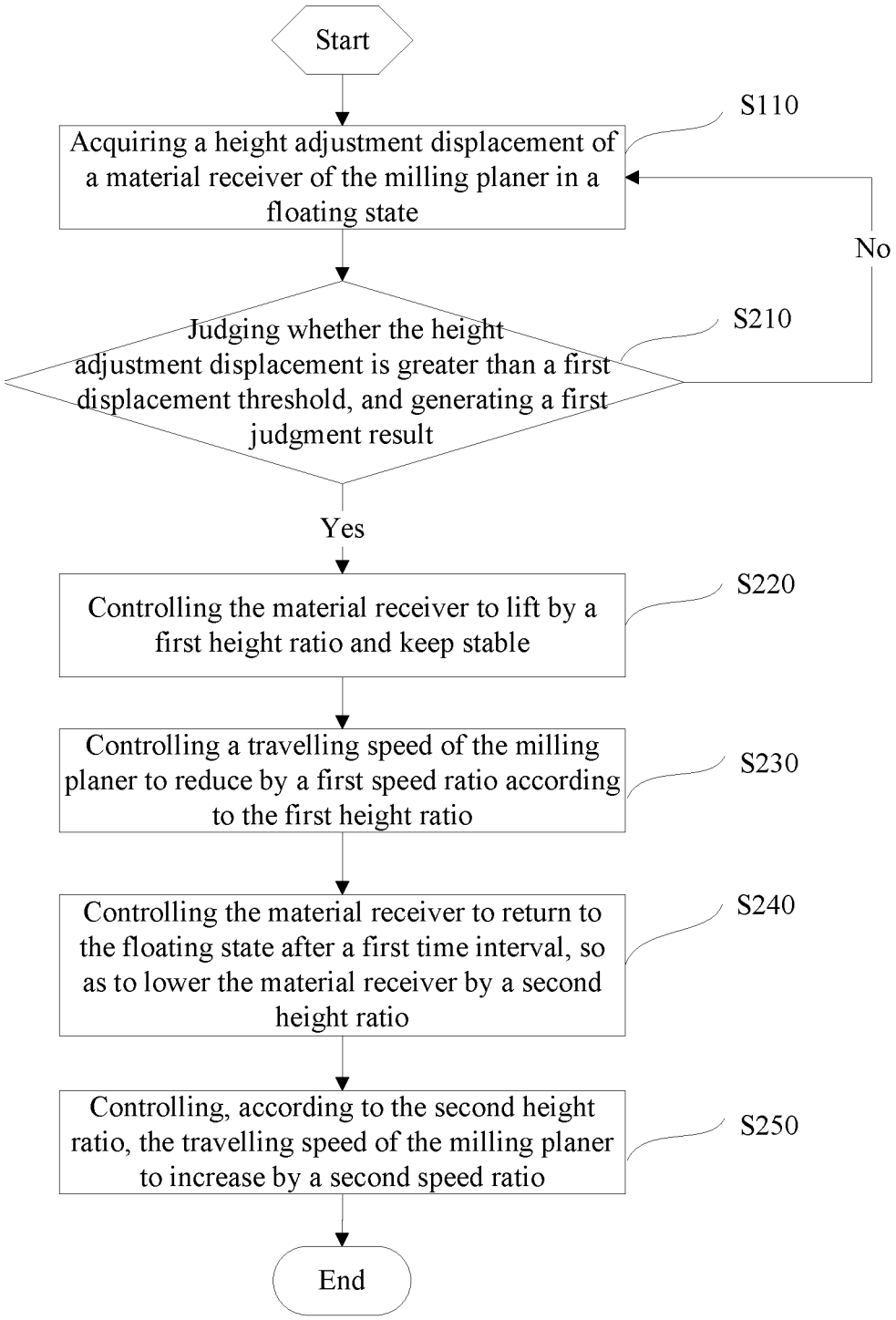
FIG. 3 shows a flowchart of a material conveying control method for a milling planer according to an embodiment of the present application.

This embodiment provides a material conveying control method for a milling planer, as shown in FIG. 3, including the following method steps.

Step S110: acquiring a height adjustment displacement of a material receiver of a milling planer in a floating state.

Step S210: judging whether the height adjustment displacement is greater than a first displacement threshold and generating a first judgment result. If the first judgment result is yes, executing Step S230, and if the first judgment result is no, executing the Step S110.

Step S220: controlling the material receiver to lift by a first height ratio and keep stable.

Step S230: controlling a travelling speed of the milling planer to reduce by a first speed ratio according to the first height ratio.

Step S240: controlling the material receiver to return to the floating state after a first time interval, so as to lower the material receiver by a second height ratio.

Step S250: controlling, according to the second height ratio, the travelling speed of the milling planer to increase by a second speed ratio.

In the material conveying control method for the milling planer in the embodiment, the steps S240 to S250 are added on the basis of the embodiments mentioned above. After the material receiver lifts by the first height ratio and remains stable, after the first time interval, through the Step S240, the material receiver is controlled to return to the floating state, so that the material receiver naturally lowers by the second height ratio under action of gravity. And then through the Step S250, the travelling speed of the milling planer is controlled to increase by the second speed ratio, so that the material receiver returns to a state of contacting a road surface. The travelling speed of the milling planer is corresponding adjusted to match a height of the material receiver, therefore, a variation of a milling volume of a milling drum is reduced. The first time interval may be set according to the travelling speed of the milling planer.

Further, the first height ratio is proportional to the first speed ratio, and the second height ratio is proportional to the second speed ratio. Therefore, the variation of the travelling speed of the milling planer may correspond to the variation of the lifting height of the material receiver. If a proportional coefficient is properly selected, the milling volume of the milling drum may be kept unchanged during a height adjustment process of the material receiver.

Figure 4:
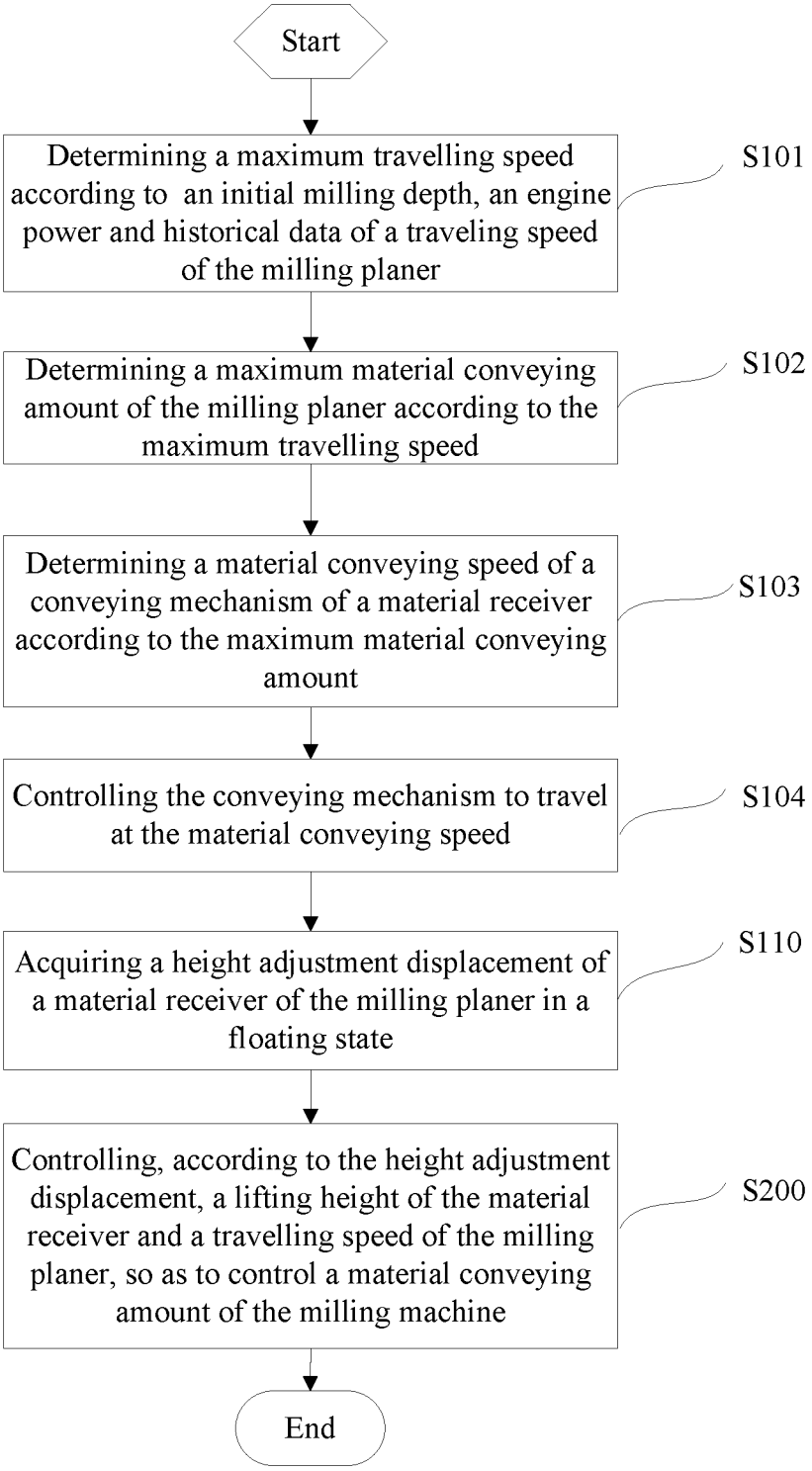
FIG. 4 shows a flowchart of a material conveying control method for a milling planer according to an embodiment of the present application.

This embodiment provides a material conveying control method for a milling planer, as shown in FIG. 4, including the following method steps.

Step S101: determining a maximum travelling speed according to an initial milling depth, an engine power and historical data of a travelling speed of the milling planer.

Step S102: determining a maximum material conveying amount of the milling planer according to the maximum travelling speed.

Step S103: determining a material conveying speed of a conveying mechanism of a material receiver according to the maximum material conveying amount.

Step S104: controlling the conveying mechanism to travel at the material conveying speed.

Step S110: acquiring a height adjustment displacement of the material receiver of the milling planer in a floating state.

Step S200: controlling, according to the height adjustment displacement, a lifting height of the material receiver and the travelling speed of the milling planer, so as to control a material conveying amount of the milling planer.

The material conveying control method for the milling planer in the embodiment is further improved on the basis of the embodiments mentioned above. That is, the steps S101 to S104 are added before the Step S110. Through the steps S101 to S103, the material conveying speed of the conveying mechanism of the material receiver may be determined according to the initial milling depth of the milling drum, the engine power, and the historical data of the travelling speed of the milling planer. And then through the Step S104, the conveying mechanism is controlled to travel at the material conveying speed, thereby reducing a change of the material conveying amount caused by a change of the material conveying speed during a milling operation. Therefore, a blanking position is kept relatively stable when the material conveying device conveys waste to a waste conveying vehicle, which facilitates the waste to be evenly loaded in bins and at the same time is beneficial to improve a service life of conveying components (such as a conveying belt) of the milling planer and efficiency of waste conveying.

The material conveying control method for the milling planer mentioned in the above embodiments may be executed by a processor in a material conveying control apparatus for a milling planer.

Figure 5:
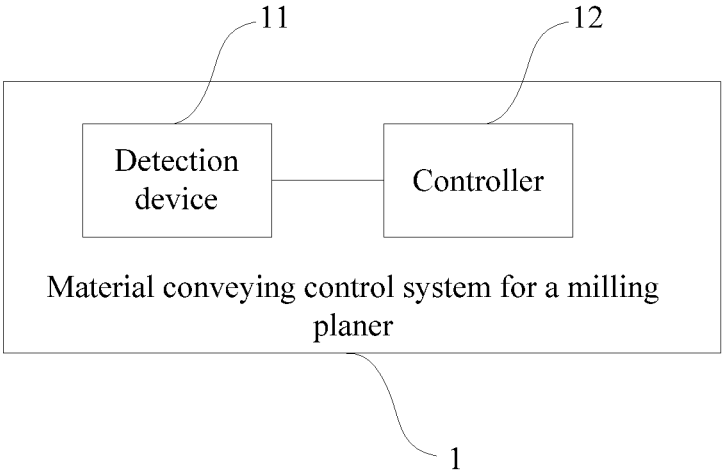
FIG. 5 shows a schematic block diagram of a material conveying control system for a milling planer according to an embodiment of the present application.
Figure 6:
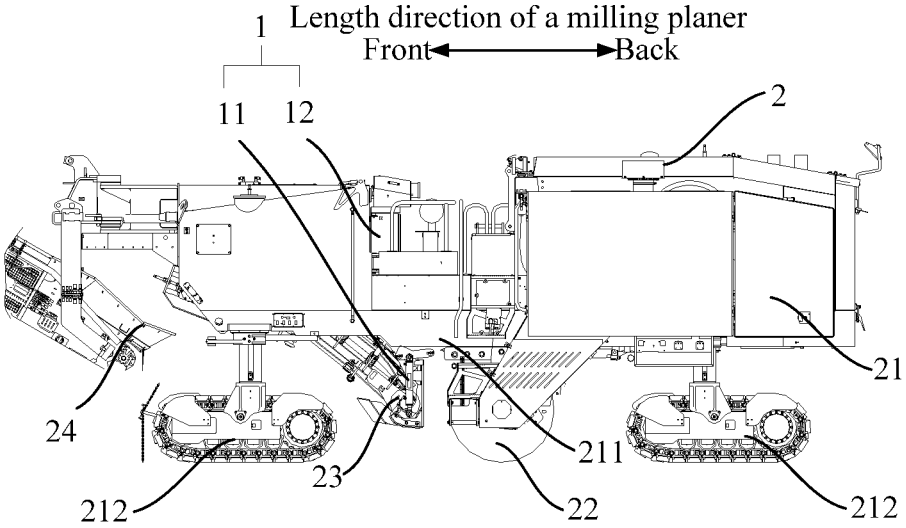
FIG. 6 shows a schematic structural diagram of a milling planer according to an embodiment of the present application.

In this embodiment, a material conveying control system for a milling planer is provided. Specifically, the material conveying control system is used for a milling planer 2. As shown in FIG. 5 and FIG. 6 (a part of a structure of the milling planer is not shown in the figures), the material conveying control system for the milling planer includes a detection device 11 and a controller 12.

Figure 7:
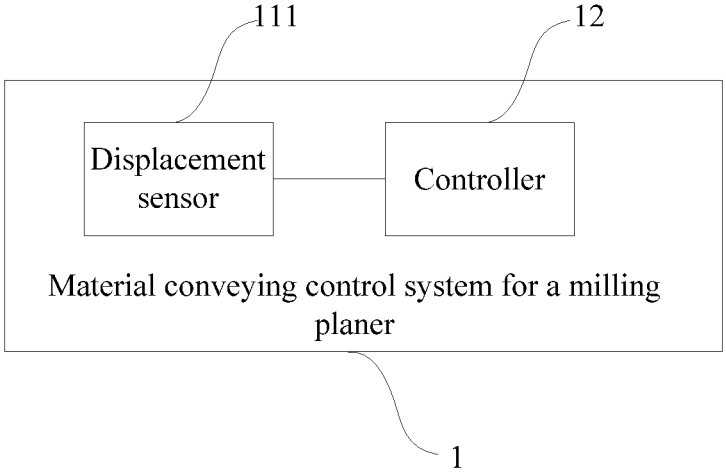
FIG. 7 shows a schematic block diagram of a material conveying control system for a milling planer according to an embodiment of the present application.

The detection device 11 is disposed on a material receiver 23 of the milling planer 2 to detect a height adjustment displacement of the material receiver 23. The controller 12 is electrically connected with the detection device 11 to receive detection data of the detection device 11, and determine a volume of an obstacle and magnitude of obstruction to the material receiver 23 according to the height adjustment displacement of the material receiver 23. In addition, the controller 12 is also electrically connected with the material receiver 23 and a travelling mechanism 212 of the milling planer 23 to control, according to the height adjustment displacement of the material receiver 23 in a floating state, a lifting height of the material receiver 23 and a travelling speed of the milling planer 2. If the material receiver 23 encounters the obstacle (including scattered waste) during a milling operation, the controller 12 controls the material receiver 23 to lift to avoid the obstacle, and controls the travelling mechanism 212 to correspondingly reduce the travelling speed, so as to reduce an influence of the obstacle on a milling volume of a milling drum 22, and then reduce an variation of a material conveying amount of the milling planer 2, which is beneficial to improve a service life of conveying components (such as a conveying belt) of the milling planer 2 and material conveying efficiency of the milling planer 2. Further, as shown in FIG. 7, the detection device 11 is specifically a displacement sensor 111. The displacement sensor 111 has advantages of high precision, small error and relatively low cost, so as to be convenient to install and use, and easy to implement.

Figure 8:
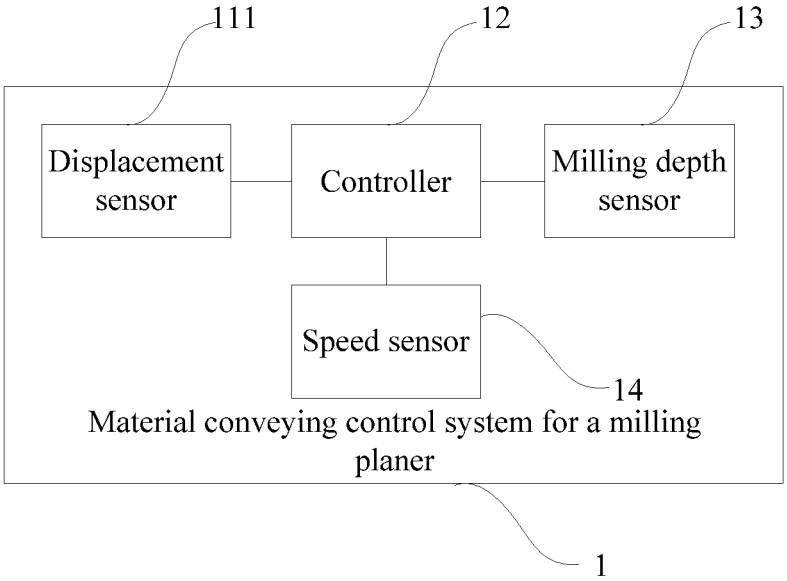
FIG. 8 shows a schematic block diagram of a material conveying control system for a milling planer according to an embodiment of the present application.
Figure 9:
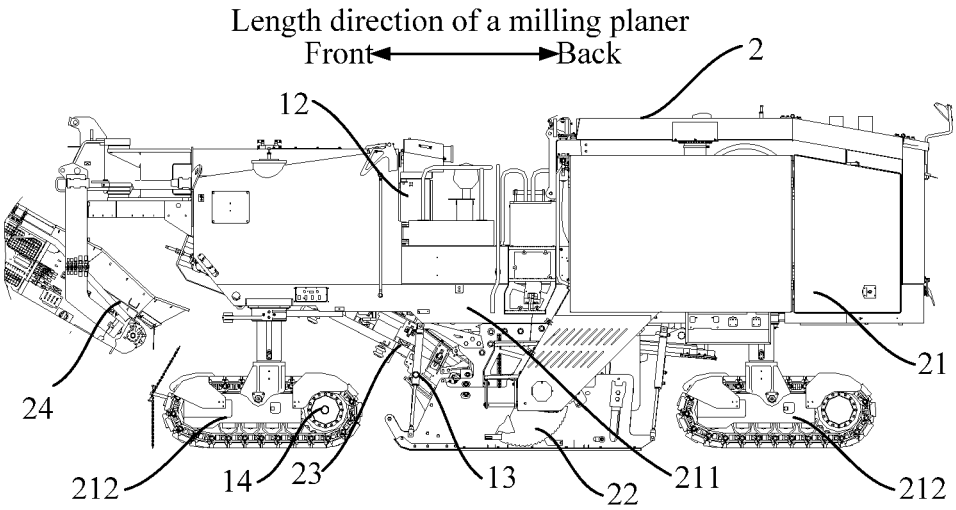
FIG. 9 shows a schematic structural diagram of a milling planer according to an embodiment of the present application.

Further, as shown in FIGS. 8 and 9 (a part of the structure of the milling planer is not shown in the figures), the material conveying control system for the milling planer further includes a milling depth sensor 13 and a speed sensor 14. The milling depth sensor 13 may be a height sensor or a displacement sensor. The milling depth sensor 13 is disposed on a connecting mechanism of the milling drum 22 to detect a milling depth of the milling drum 22. The speed sensor 14 may be an angular velocity sensor or a linear velocity sensor. The speed sensor 14 is disposed on the travelling mechanism 212 of the milling planer 2 to detect the travelling speed of the travelling mechanism 212. The controller 12 is electrically connected with the milling depth sensor 13 and the speed sensor 14 to determine a material conveying speed of a conveying mechanism 232 of the material receiver 23 according to a milling depth of the milling drum 22, the travelling speed of the travelling mechanism 212, and an engine power of the milling planer 2, so as to make the conveying mechanism 232 travel at the material conveying speed. Therefore, a change of the material conveying amount caused by a change of the material conveying speed of the conveying mechanism 232 may be reduced, so that a blanking position remains relatively stable when a material conveying device 24 conveys the waste to a waste conveying vehicle. In addition, a bin of the conveying vehicle may be loaded with waste relatively evenly, thereby improving a utilization rate of the bin of the conveying vehicle and efficiency of waste conveying.

Figure 10:
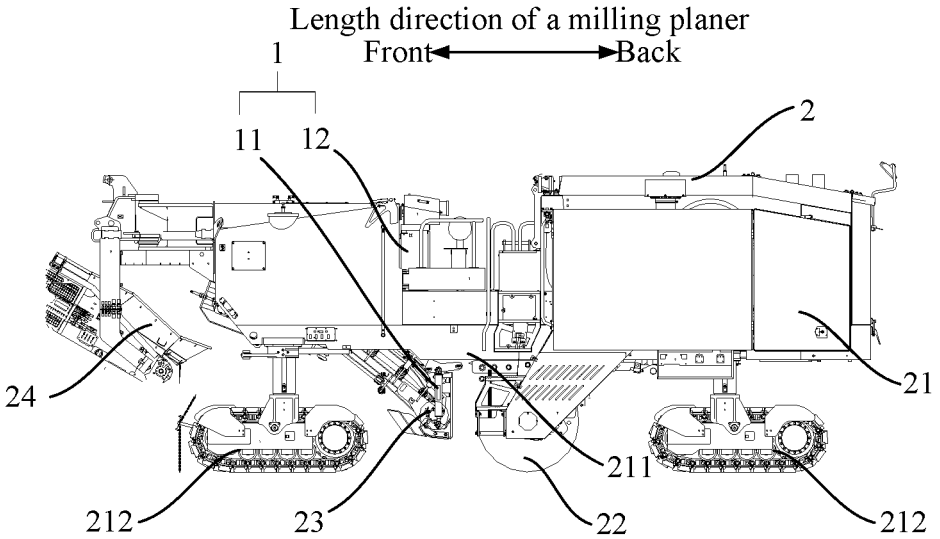
FIG. 10 shows a schematic structural diagram of a milling planer according to an embodiment of the present application.

In the embodiment, a milling planer 2 is provided. As shown in FIG. 10 (a part of a structure of the milling planer is not shown in the figure), the milling planer 2 includes a milling planer body 21, a milling drum 22, a material receiver 23, a material conveying device 24 and the material conveying control system 1 for the milling planer in any of the above mentioned embodiments.

The milling planer body 21 is a main structure of the milling planer 2. The milling planer body 21 is provided with a frame 211 and a travelling mechanism 212 connected to the frame 211, so as to drive the milling planer body 21 through the travelling mechanism 212. The milling drum 22 is disposed at a bottom of the milling planer body 21 and is connected with the frame 211. The milling drum 22 may be rotated to perform a milling operation on a road surface and realize road surface renovation. The material receiver 23 is disposed at the bottom of the milling planer body 21 and connected with the frame 211. The material receiver 23 is disposed at a discharge position of the milling drum 22, so as to collect waste produced by the milling drum 22 during the milling operation. The material conveying device 24 is disposed on a front side of the material receiver 23 along a length direction of the milling planer body 21. The material receiver 23 conveys the collected waste to the material conveying device 24, thereby conveying the waste to outside through the material conveying device 24. and then conveying the waste to a bin of the waste conveying vehicle. Therefore, the waste is conveyed to a designated location by the conveying vehicle to complete conveying of the waste.

The detection device 11 and the controller 12 in the material conveying control system for the milling planer are disposed on the material receiver 23. The detection device 11 is disposed on the material receiver 23 to detect a height adjustment displacement of the material receiver 23. The controller 12 is electrically connected with the detection device 11 to receive detection data of the detection device 11, and to determine a volume of an obstacle and magnitude of an obstruction effect on the material receiver 23 according to the height adjustment displacement of the material receiver 23. The controller 12 is also electrically connected with the material receiver 23 and the travelling mechanism 212 to control a lifting height of the material receiver 23 and the travelling speed of the milling planer body 21 according to the height adjustment displacement of the material receiver 23 in the floating state. If the material receiver 23 encounters the obstacle (including scattered waste) during the milling operation, the controller 12 controls the material receiver 23 to lift to avoid the obstacle, and at the same time controls the travelling mechanism 212 of the milling planer 2 to correspondingly reduce the travelling speed. Therefore, an influence of the obstacle on the milling volume of the milling drum 22 is reduced, and a variation of a material conveying amount of the milling planer 2 is reduced, so as to improve a service life of the conveying components (such as the conveying belt) and conveying efficiency of the milling planer 2. The initial state of the material receiver 23 is the floating state, that is, a state in which the material receiver 23 itself has no driving force, and only lifts or lowers under action of external force.

In addition, the milling planer 2 in the embodiment also has beneficial effects of the material conveying control system 1 for the milling planer in any of the above embodiments, which will not be repeated here.

This embodiment provides a milling planer 2 further improved on the basis of the embodiments mentioned above.

Figure 11:
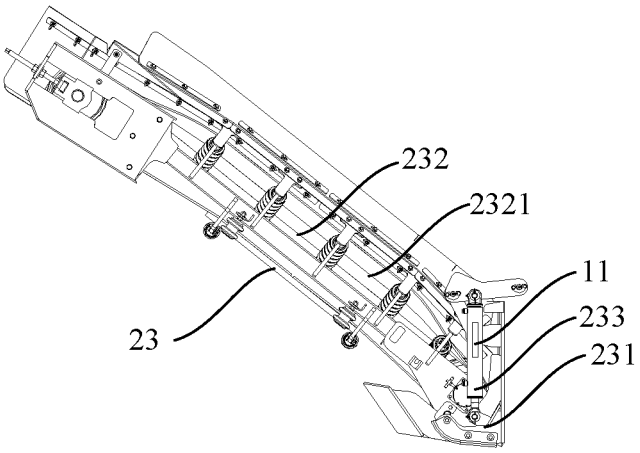
FIG. 11 shows a schematic structural diagram of a material receiver according to an embodiment of the present application.

As shown in FIG. 10 and FIG. 11 (a part of a structure of the milling planer is not shown in the figures), a material receiver 23 specifically includes a material receiving mechanism 231, a conveying mechanism 232 and a height adjustment mechanism 233. The material receiving mechanism 231 is disposed on a front side of a milling drum 22 along a length direction of a milling planer body 21. A material receiving end of the material receiving mechanism 231 is disposed at a discharge position of the milling drum 22, so as to facilitate collection of the waste generated by the milling drum 22 during the milling operation. A material discharging end of the material receiving mechanism 231 is disposed corresponding to a material conveying device 24, so that the waste in the material receiving mechanism 231 can fall into the material conveying device 24 through the material discharging end, and the waste can be conveyed into a material conveying vehicle through the material conveying device 24. The conveying mechanism 232 is disposed on the material receiving mechanism 231 and extends along a length direction of the material receiving mechanism 231 to convey the waste in the material receiving mechanism 231 from the material receiving end to the material discharging end through movement of the conveying mechanism 232. The conveying mechanism 232 is specifically a conveying belt mechanism, on which a conveying belt 2321 is disposed as a conveying component for conveying the waste. An end of the height adjustment mechanism 233 is connected with the frame 211 of the milling planer body 21. Another end of the height adjustment mechanism 233 is connected with the material receiving mechanism 231, so as to drive the material receiving mechanism 231 to perform a height adjustment movement through the height adjustment mechanism 233. The height adjustment mechanism 233 is specifically a telescopic oil cylinder or a telescopic cylinder, so as to drive the material receiving mechanism 231 to perform a height adjustment movement through a telescopic movement of the telescopic oil cylinder or the telescopic cylinder. An initial state of the height adjustment mechanism 233 is the floating state, that is, a state in which the height adjustment mechanism 233 itself has no driving force and only lifts or lowers under action of external force.

The controller 12 of the material conveying control system 1 for the milling planer is electrically connected with the conveying mechanism 232 and the height adjustment mechanism 233 to control working states of the conveying mechanism 232 and the height adjustment mechanism 233. Specifically, the controller 12 determines a material conveying speed of the conveying mechanism 232 before an operation, so as to control the conveying mechanism 232 to operate at the material conveying speed during the operation, and further prevent the material conveying speed from changing during the operation. If the material receiving mechanism 231 encounters an obstacle, the controller 12 drives the material receiving mechanism 231 to lift to avoid the obstacle by controlling the movement of the height adjustment mechanism 233, so as to reduce resistance. At the same time, the controller 12 controls the travelling mechanism 212 to reduce the travelling speed correspondingly to avoid reducing a variation of a milling volume of the milling drum 22. Further, after a first time interval, the controller 12 controls the height adjustment mechanism 233 to return to the floating state, so that the material receiver 23 naturally lowers under action of gravity, and at the same time the controller 12 controls the travelling mechanism 212 to increase the travelling speed correspondingly to match the height of the material receiver 23.

The technical solutions according to some embodiments of the present application are described in detail above with reference to the accompanying drawings. By controlling the lifting height of the material receiver and the travelling speed of the milling planer body at the same time, the variation of the milling volume is reduced. Therefore an impact of the spilled waste on the material conveying amount of the milling planer is reduced, and the process that waste conveys from the milling planer to the waste conveying vehicle is kept relatively stable, so as to improve the service life of the conveying components (such as the conveying belt) of the milling planer and the material conveying efficiency of the milling planer.

Figure 12:
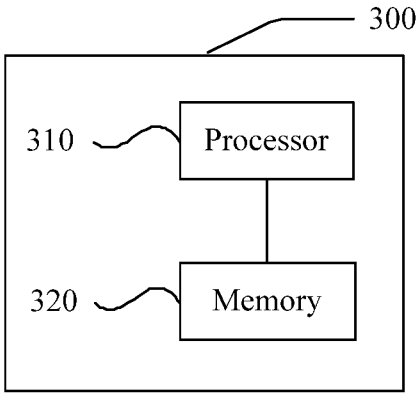
FIG. 12 shows a schematic structural block diagram of a material conveying control apparatus for a milling planer according to an embodiment of the present application.

This embodiment provides a material conveying control apparatus for a milling planer. As shown in FIG. 12, a material conveying control apparatus 300 for a milling planer includes a processor 310 and a memory 320 for storing executable instructions of the processor 310. The processor 310 executes the following instructions: acquiring a height adjustment displacement of a material receiver of the milling planer in a floating state; controlling, according to the height adjustment displacement, a lifting height of the material receiver and a travelling speed of the milling planer, so as to control a material conveying amount of the milling planer.

Specifically, the processor 310 controls the lifting height of the material receiver and the travelling speed of the milling planer at the same time by executing the above-mentioned instructions stored in the memory 320, so as to reduce a variation of a milling volume. Therefore, a process that waste conveys from the milling planer to a waste conveying vehicle is kept relatively stable, and at the same time, an amount of waste generated by the milling planer per unit time is relatively stable. In addition, the milling volume per unit time of the milling planer fails to exceed the load of conveying components (such as a conveying belt) to a certain extent, thereby delaying wear of the conveying components and increasing a service life of the conveying components.

Further, the processor 310 further executes the following instructions: judging whether the height adjustment displacement is greater than a first displacement threshold and generating a first judgment result; if the first judgment result is yes, controlling the material receiver to lift by a first height ratio and keep stable; controlling the travelling speed of the milling planer to reduce by the first speed ratio according to the first height ratio; and if the first judgment result is no, acquiring the height adjustment displacement of the material receiver of the milling planer in the floating state.

Specifically, by executing the above-mentioned instructions stored in the memory 320, the processor 310 determines a volume of an obstacle by judging whether the height adjustment displacement of the material receiver is greater than the first displacement threshold. If the height adjustment displacement of the material receiver is greater than the first displacement threshold, it indicates that the volume of the obstacle is large, a blocking effect on the material receiver is relatively great, and an effect on the milling volume of the milling planer is relatively great. At the same time, by controlling the material receiver to lift by the first height ratio and keep stable, the material receiver may avoid the obstacle, so as to reduce resistance. Further, the travelling speed of the milling planer is controlled to correspondingly reduce by the first speed ratio according to the first height ratio, so that a change of the travelling speed of the milling planer matches the lifting height of the material receiver. If the waste is scattered on an unmilled road surface, a variation of a material conveying amount of the milling planer may be reduced. Therefore, a conveying amount of a conveying mechanism is ensured to be relatively stable, so as to improve a service life of conveying components (such as a conveying belt) of the milling planer.

Further, the processor 310 executes the following instructions: controlling the material receiver to return to the floating state after a first time interval, so as to lower the material receiver by a second height ratio; controlling, according to the second height ratio, the travelling speed of the milling planer to increase by a second speed ratio.

Specifically, by executing the above instructions stored in the memory 320, the processor 310 realizes determining that after the material receiver lifts by the first height ratio and remains stable, after the first time interval, the material receiver has passed the obstacle, so as to control the material receiver to return to the floating state, so that the material receiver naturally lowers by the second height ratio under action of gravity and the material receiver returns to a state of contacting a road surface. Correspondingly, the travelling speed of the milling planer is controlled to increase by the second speed ratio, so that the travelling speed of the milling planer matches the height of the material receiver, thereby reducing the variation of the milling volume of the milling drum.

Further, the first height ratio is proportional to the first speed ratio, and the second height ratio is proportional to the second speed ratio. Therefore, a variation in the travelling speed of the milling planer corresponds to a variation in the lifting height of the material receiver. If a proportional coefficient is properly selected, the milling volume of the milling drum may remain unchanged during a height adjustment process of the material receiver.

Furthermore, before executing the instruction of acquiring the height adjustment displacement of the material receiver of the milling planer in the floating state, the processor 310 also executes the following instructions: determining a maximum travelling speed according to an initial milling depth, an engine power and historical data of the travelling speed of a milling planer; determining a maximum material conveying amount of the milling planer according to the maximum travelling speed; determining a material conveying speed of a conveying mechanism of the material receiver according to the maximum material conveying amount; controlling the conveying mechanism to travel at the material conveying speed.

Specifically, by executing the above-mentioned instructions stored in the memory 320, the processor 310 realizes that the material conveying speed of the conveying mechanism of the material receiver is determined according to the initial milling depth of the milling drum, the engine power and the historical data of the travelling speed of the milling planer; and the conveying mechanism is controlled to travel at the material conveying speed. Therefore, a change of the material conveying amount caused by a change of the material conveying speed may be reduced during the milling operation, and then a blanking position of the material conveying device may be kept relatively stable when the waste is conveyed to the waste conveying vehicle. In addition, it is convenient for a bin to load the waste evenly, so as to improve the service life of the conveying components (such as the conveying belt) of the milling planer and the efficiency of conveying the waste.

In the specification, any description of a process or method in a flowchart or otherwise described herein may be understood to represent a module, a fragment, or a part of code representing executable instructions that include one or more steps for implementing a particular logical function or procedure. Moreover, a scope of the preferred embodiments of this specification includes alternative implementations, which may be performed out of the order shown or discussed, including in a substantially simultaneous manner or in a reverse order depending upon the functionality involved function, which may be understood by those skilled in the art to which the embodiments of this specification belong.

For example, the logic and/or steps represented in flowcharts or otherwise described herein may be considered an ordered listing of executable instructions for implementing the logical functions, may be embodied in any computer-readable medium, in order to use with, or in conjunction with, an instruction execution system, apparatus, or device (such as a computer-based system, a system including a processor, or other system that may fetch instructions from and execute instructions from an instruction execution system, apparatus, or apparatus). For the purposes of this specification, a "computer-readable medium" may be any device that may contain, store, communicate, propagate, or transport the program for use by or in connection with an instruction execution system, apparatus, or apparatus. More specific examples (non-exhaustive list) of the computer readable media include the following: an electrical connection with one or more wiring (electronic devices), portable computer disk cartridges (magnetic devices), random access memory (RAM), Read Only Memory (ROM), Erasable Editable Read Only Memory (EPROM or Flash Memory), Fiber Optic Devices, and Portable Compact Disc Read Only Memory (CDROM). In addition, the computer readable medium may even be paper or other suitable medium on which the program may be printed, as may be done, for example, by optically scanning the paper or other medium, followed by editing, interpretation, or other suitable means as necessary process to obtain the program electronically and then store it in computer memory.

Parts of the embodiments according to the present application may be implemented in hardware, software, firmware, or a combination thereof. In the above-described embodiments, various steps or methods may be implemented in software or firmware stored in memory and executed by a suitable instruction execution system. For example, if implemented in hardware, as in another embodiment, it may be implemented by any one or a combination of the following techniques known in the art: Discrete logic circuits, application-specific integrated circuits with suitable combinational logic gates, Programmable Gate Arrays (PGA), Field Programmable Gate Arrays (FPGA), etc.

Those of ordinary skill in the art may understand that all or part of the steps carried by the methods of the above embodiments may be completed by instructing relevant hardware through a program, and the program may be stored in a computer-readable storage medium, and when the program is executed, including one or a combination of the steps of the method embodiment.

In addition, each functional unit in various embodiments of the present application may be integrated into one processing module, or each unit may exist physically alone, or two or more units may be integrated into one module. The above-mentioned integrated modules may be implemented in the form of hardware and may also be implemented in the form of software function modules. If the integrated modules are implemented in the form of software functional modules and sold or used as independent products, they may also be stored in a computer-readable storage medium.

The above-mentioned storage medium may be a read-only memory, a magnetic disk or an optical disk, and the like.

The above are only preferred embodiments according to the present application and are not intended to limit the technical solutions of the present application. For those skilled in the art, the technical solutions of the present application may have various modifications and changes. Any modification, equivalent replacement, improvement, etc. made within the spirit and principle of this application shall be included within the protection scope of this application.

What is claimed is:

1. A material conveying control method for a milling planer, comprising:

acquiring a height adjustment displacement of a material receiver of the milling planer in a floating state; and controlling, according to the height adjustment displacement, a lifting height of the material receiver and a travelling speed of the milling planer, so as to control a material conveying amount of the milling planer, wherein the controlling, according to the height adjustment displacement, a lifting height of the material receiver and a travelling speed of the milling planer specifically comprises:

controlling, if the height adjustment displacement is greater than a first displacement threshold, the material receiver to lift by a first height ratio and keep stable; and controlling the travelling speed of the milling planer to reduce by a first speed ratio according to the first height ratio.

2. The material conveying control method for the milling planer according to claim 1, after the controlling the travelling speed of the milling planer to reduce by a first speed ratio according to the first height ratio, further comprising:

controlling the material receiver to return to the floating state after a first time interval, so as to lower the material receiver by a second height ratio; and controlling, according to the second height ratio, the travelling speed of the milling planer to increase by a second speed ratio.

3. The material conveying control method for the milling planer according to claim 2, wherein the first height ratio is proportional to the first speed ratio; and the second height ratio is proportional to the second speed ratio.

4. The material conveying control method for the milling planer according to claim 1, before the acquiring a height adjustment displacement of a material receiver of the milling planer in a floating state, further comprising:

determining a maximum travelling speed according to an initial milling depth, an engine power and historical data of the travelling speed of the milling planer;

determining a maximum material conveying amount of the milling planer according to the maximum travelling speed;

determining a material conveying speed of a conveying mechanism of the material receiver according to the maximum material conveying amount; and controlling the conveying mechanism to travel at the material conveying speed.

5. The material conveying control method for the milling planer according to claim 2, before the acquiring a height adjustment displacement of a material receiver of the milling planer in a floating state, further comprising:

determining a maximum travelling speed according to an initial milling depth, an engine power and historical data of the travelling speed of the milling planer;

determining a maximum material conveying amount of the milling planer according to the maximum travelling speed;

determining a material conveying speed of a conveying mechanism of the material receiver according to the maximum material conveying amount; and controlling the conveying mechanism to travel at the material conveying speed.

6. The material conveying control method for the milling planer according to claim 3, before the acquiring a height adjustment displacement of a material receiver of the milling planer in a floating state, further comprising:

determining a maximum travelling speed according to an initial milling depth, an engine power and historical data of the travelling speed of the milling planer;

determining a maximum material conveying amount of the milling planer according to the maximum travelling speed;

determining a material conveying speed of a conveying mechanism of the material receiver according to the maximum material conveying amount; and controlling the conveying mechanism to travel at the material conveying speed.

7. A material conveying control system for a milling planer, comprising:

a detection device disposed on a material receiver of a milling planer, and used for detecting a height adjustment displacement of the material receiver; and a controller electrically connected with the material receiver, the detection device and a travelling mechanism of the milling planer, and used for controlling, according to the height adjustment displacement of the material receiver in a floating state, a lifting height of the material receiver and a travelling speed of the milling planer, so as to control a material conveying amount of the milling planer, wherein the controlling, according to the height adjustment displacement of the material receiver in a floating state, a lifting height of the material receiver and a travelling speed of the milling planer specifically comprises:

controlling, if the height adjustment displacement is greater than a first displacement threshold, the material receiver to lift by a first height ratio and keep stable; and controlling the travelling speed of the milling planer to reduce by a first speed ratio according to the first height ratio.

8. The material conveying control system for the milling planer according to claim 7, wherein the detection device is a displacement sensor.

9. The material conveying control system for the milling planer according to claim 7, further comprising:

a milling depth sensor disposed on the milling planer, and used for detecting a milling depth of a milling drum of the milling planer; and a speed sensor disposed on the travelling mechanism of the milling planer, and used for detecting a travelling speed of the travelling mechanism, wherein the controller is electrically connected with the milling depth sensor and the speed sensor, so as to control a material conveying speed of the material receiver according to the milling depth of the milling drum, the travelling speed of the travelling mechanism and an engine power of the milling planer.

10. The material conveying control system for the milling planer according to claim 8, further comprising:

a milling depth sensor disposed on the milling planer, and used for detecting a milling depth of a milling drum of the milling planer; and a speed sensor disposed on the travelling mechanism of the milling planer, and used for detecting a travelling speed of the travelling mechanism, wherein the controller is electrically connected with the milling depth sensor and the speed sensor, so as to control a material conveying speed of the material receiver according to the milling depth of the milling drum, the travelling speed of the travelling mechanism and an engine power of the milling planer.

11. A milling planer, comprising:

a milling planer body, the milling planer body being disposed with a travelling mechanism;

a milling drum disposed at a bottom of the milling planer body and used for milling a road surface;

a material receiver disposed at the bottom of the milling planer body and at a discharge position of the milling drum, and used for collecting waste generated during a milling operation of the milling drum;

a material conveying device disposed on a front side of the material receiver along a length direction of the milling planer body and used for outward conveying the waste collected by the material receiver; and the material conveying control system for the milling planer according to claim 7, wherein the detection device of the material conveying control system for the milling planer is disposed on the material receiver, and the controller of the material conveying control system for the milling planer is electrically connected with the material receiver, the detection device and the travelling mechanism, to control the lifting height of the material receiver and the travelling speed of the travelling mechanism according to the height adjustment displacement of the material receiver in the floating state, so as to control the material conveying amount of the milling planer;

wherein an initial state of the material receiver is the floating state;

wherein the controlling the lifting height of the material receiver and the travelling speed of the travelling mechanism according to the height adjustment displacement of the material receiver in the floating state specifically comprises:

controlling, if the height adjustment displacement is greater than a first displacement threshold, the material receiver to lift by a first height ratio and keep stable; and controlling the travelling speed of the milling planer to reduce by a first speed ratio according to the first height ratio.

12. The milling planer according to claim 11, wherein the material receiver comprises:

a material receiving mechanism disposed on a front side of the milling drum along the length direction of the milling planer body, a material receiving end of the material receiving mechanism being disposed at the discharge position of the milling drum to collect the waste generated during a milling operation of the milling drum, and a material discharge end of the material receiving mechanism being disposed corresponding to the material conveying device;

a conveying mechanism disposed on the material receiving mechanism and extended along a length direction of the material receiving mechanism, and the conveying mechanism being used for conveying the waste in the material receiving mechanism to the material conveying device; and a height adjustment mechanism disposed at the bottom of the milling planer body, an end of the height adjustment mechanism being connected with the milling planer body, another end of the height adjustment mechanism being connected with the material receiving mechanism, so as to drive the material receiving mechanism to perform a height adjustment movement;

wherein the controller is electrically connected with the conveying mechanism and the height adjustment mechanism to control working states of the conveying mechanism and the height adjustment mechanism, and an initial state of the height adjustment mechanism is the floating state.

13. The milling planer according to claim 12, wherein the height adjustment mechanism is a telescopic oil cylinder or a telescopic cylinder.

14. A material conveying control apparatus for a milling planer, comprising:

a processor; and a memory for storing executable instructions of the processor;

wherein the processor executes the following instructions:

acquiring a height adjustment displacement of a material receiver of the milling planer in a floating state; and controlling, according to the height adjustment displacement, a lifting height of the material receiver and a travelling speed of the milling planer, so as to control a material conveying amount of the milling planer;

wherein the processor further executes the following instructions:

controlling, if the height adjustment displacement is greater than a first displacement threshold, the material receiver to lift by a first height ratio and keep stable; and controlling the travelling speed of the milling planer to reduce by a first speed ratio according to the first height ratio.

15. The material conveying control apparatus for the milling planer according to claim 14, wherein the processor further executes the following instructions:

controlling the material receiver to return to the floating state after a first time interval, so as to lower the material receiver by a second height ratio; and controlling, according to the second height ratio, the travelling speed of the milling planer to increase by a second speed ratio.

16. The material conveying control apparatus for the milling planer according to claim 15, wherein the first height ratio is proportional to the first speed ratio; and the second height ratio is proportional to the second speed ratio.

17. The material conveying control apparatus for the milling planer according to claim 14, wherein before the acquiring a height adjustment displacement of a material receiver of the milling planer in a floating state, the processor further executes the following instructions:

determining a maximum travelling speed according to an initial milling depth, an engine power and historical data of the travelling speed of a milling planer;

determining a maximum material conveying amount of the milling planer according to the maximum travelling speed;

determining a material conveying speed of a conveying mechanism of the material receiver according to the maximum material conveying amount; and controlling the conveying mechanism to travel at the material conveying speed.

* * * * *